US011268360B1

(12) United States Patent
Aguilar et al.

(10) Patent No.: US 11,268,360 B1
(45) Date of Patent: Mar. 8, 2022

(54) DYNAMIC POSITIONING GAS LIFT (DPGL) SYSTEM

(71) Applicant: Narciso De Jesus Aguilar, Katy, TX (US)

(72) Inventors: Narciso De Jesus Aguilar, Katy, TX (US); Andre Jesus Aguilar Herrera, Katy, TX (US)

( * ) Notice: Subject to any disclaimer, the term of this patent is extended or adjusted under 35 U.S.C. 154(b) by 195 days.

(21) Appl. No.: 16/514,929

(22) Filed: Jul. 17, 2019

Related U.S. Application Data

(60) Provisional application No. 62/699,046, filed on Jul. 17, 2018.

(51) Int. Cl.
*E21B 43/12* (2006.01)
*E21B 34/10* (2006.01)
*F04F 5/46* (2006.01)

(52) U.S. Cl.
CPC ..... *E21B 43/124* (2013.01); *E21B 34/10* (2013.01); *E21B 43/123* (2013.01); *F04F 5/464* (2013.01); *E21B 2200/05* (2020.05)

(58) Field of Classification Search
CPC .... E21B 43/123; E21B 43/1235; E21B 43/13; E21B 43/122; E21B 43/124; E21B 43/129; E21B 34/10; E21B 33/00; E21B 2200/05; F04F 5/02; F04F 5/46; F04F 5/464; F04F 5/466; F04F 9/00
See application file for complete search history.

(56) References Cited

U.S. PATENT DOCUMENTS 50,710 A * 10/1865 Hubbell ..... F04F 5/464 417/172
2,041,803 A * 5/1936 Wolff ..... F04F 5/466 417/172
4,444,251 A * 4/1984 Lefebvre ..... E21B 34/08 166/105
5,372,190 A * 12/1994 Coleman ..... E21B 43/124 166/105
6,050,340 A * 4/2000 Scott ..... E21B 23/00 166/105

* cited by examiner

*Primary Examiner* — George S Gray

(57) ABSTRACT

The object of the present invention is to create the elements and parts necessary to supply lifting energy to a motionless fluid in a fluid container, together with the capability to change the level or position where the motive fluid can be injected. It is done with a string and an artifact that utilizes the educing principle to draws forth a motionless fluid and induce its movement using another fluid (motive fluid) as a medium. The main part of the invention is this educing artifact that can be fabricated in one body without moving parts, but it also can be fabricated adding optional features such as an outer ring used as sealing mechanism around the artifact that seals the communication between the lower and the upper sides of the fluid container. The artifact operates with a fluid fed by a pumping or compression system.

7 Claims, 15 Drawing Sheets

DYNAMIC POSITIONING GAS LIFT (DPGL) SYSTEM

The object of the present invention is to create the elements and parts necessary to supply lifting energy through a motive fluid to a motionless fluid confined in a container together with the capability to change the level or position where the motive fluid can be injected according the system needs. The present invention includes an educing artifact that provides a motive force to fluids confined either in a pipeline but also other containers with different shapes. The main part of the invention is an educing artifact, with the option to be fabricated in one body without moving parts, or be fabricated adding a sealing mechanism, which comprises a sealing ring around the artifact that seals the communication between the lower and the upper sides of the fluid container and also an optional integrated check valve to avoid any fluid to flowback.

To operate the artifact, it is required a source of fluid supply acting as motive fluid, hereinafter also referred interchangeably as the first fluid or motive fluid, or drawer fluid, in order to induce movement, either increasing the pressure or reducing the density of a static or motionless fluid, hereinafter also referred interchangeably as the second fluid or motionless fluid, or drawn fluid. A brief interaction of the fluids inside the artifact will produce the movement or levitation required by the motionless fluid to be transported or raised. The artifact invented can be utilized in different locations onshore and offshore (Shallow and Deepwater) and in different positions in order to support the transportation of fluids. The location of the artifact is dynamic, meaning that the artifact can be placed in different locations along the motionless fluid container.

The artifact can change location at any level or any distance required or imposed by the process. To change location, the artifact needs to be connected to one end of a string, hereinafter also referred interchangeably as the first fluid feeder or motive fluid feeder, or drawer fluid feeder, or tubing, or feeder. To operate the artifact this must be connected to a string and introduced into the motionless fluid container. The length of the string must be determined according motionless fluid level in the motionless fluid container. Some of the places where the artifact can be located are flowlines, pipes, wells, tanks, and raisers. In order to avoid undesired backpressure at the fluid destinations this artifact can be installed together with a check valve. The invention can be manufactured in different sizes in order to fit the system requirements.

CROSS-REFERENCE TO RELATED APPLICATIONS

The present invention can be used as a lifter to support the transportation of low-pressure fluid systems, heavy density or viscous fluids with low mobility. The motive fluid can be diverse, with a wide range of densities and viscosities, including gas and liquids.

STATEMENT REGARDING FEDERALLY SPONSORED RESEARCH OR DEVELOPMENT

Not Applicable

REFERENCE TO A "SEQUENCE LISTING," A TABLE, OR A COMPUTER PROGRAM LISTING APPENDIX SUBMITTED ON A COMPACT DISC

Not Applicable

BACKGROUND OF THE INVENTION

1. Field of the Invention

The present invention is related with the use of the educing effect exerted by one fluid over another when they are put closely enough in two or more hydraulic shaped cavities or chambers such as one of them draws forth the other out inducing movement. The fluids may have different densities. The lighter fluid will reduce the density of the heavier fluid when they mix out of the artifact, or vice versa. This effect will reduce the backpressure of the system containing the motionless fluid (drawn fluid) at the source. Along with the educing artifact, the invention comprises also the entire system with the capability to move the educing artifact along the motionless fluid container, changing height or position as necessary according the pressure or process variables requirement of the whole system. To change the artifact position, this needs to be attached to a dynamic lifting mechanism comprising a string that can be manipulated from a different location than the motionless fluid level. The string can be wound in a reel. The reel can be operated manually or automatically if automized, to unwound or wound the string to change the position of the artifact. The end of the string opposite to the artifact is connected to a motive fluid feeder equipment, that can be a pump or a compressor.

Despite the configuration in which a check valve and a sealing ring are incorporated into the body's artifact, this is a static piece of equipment with not moving parts other than the sealing ring. Particularly, the invention applies in the use of lifting fluid in any container, no matter its shape, such as pipes, oil wells, oil flowlines, risers, and vessels, no matter the container location, which can be onshore or offshore, including subsea applications.

The artifact combines the pressure and velocity produced by an ejector with the lifting functionality of the gas lift system, to raise the fluid at higher pressure and lower density.

2. Background of the Related Art

The transportation of the fluids in a cylindrical container, pipe or well system depends on the pressure at the source or origin of such container, pipe or well system. This pressure can be produced by any mean natural or manufactured by man, and according the final purpose it must be enough to transport the fluid from one end to another in the container, pipe or well, and in many cases with enough discharge pressure to continue with another process downstream the original system.

For example, the transportation of fluids hydrocarbon in a well can involves different kind of technologies to makes the fluid flows to an end point at the surface, generally with a required discharge pressure. Such end point can be located at the same level of the production facilities in the case of an onshore field, but it can also be necessary to make the fluid flows up to a location or dry surface out of the subsea in case of an offshore facility. In some cases, the well should have enough pressure to make the fluid arrive to any desired destination. In other cases, the installation of systems, such as gas lift, help to reduce the backpressure on the well. These systems are generally installed to be operated in one position, all of them at or near the bottom of the well.

There are many ways to produce oil using gas lift methods. Traditionally a lifting system is part of the transportation system or well completion elements such as the gas lift valves, but others, and particularly in the case of subsea systems, the gas lift is connected to the subsea pipe manifolds. The gas can be also introduced in many other ways into the transportation system, including connecting a gas transportation pipe into the existing system, by replacing piping spools or hot tapping works.

Without being an integral part of the transportation system, the current invention can be used in many different situations in which the pressure at the source is insufficient to transport the fluid to its destination or when is required to reduce the density or induce movement to a static fluid for its transportation, including producing wells, transportation flowlines, transportation pipes or pipelines, confined spaces, subsea risers, or any other fluid container. The artifact can be installed or removed from the process any time, as necessary.

The use of this artifact only requires a source of another fluid to produce the educing effect on the one which is desired to transport. It does not require direct sources of electrical power to make the artifact work, so it can be implemented in many cases where the electrical power has limitations.

BRIEF SUMMARY OF THE INVENTION

The object of the present invention is to provide a fluid lifting system comprising string, the mechanism to change the educing artifact position, which may be a manual or automatized reel, and an artifact that utilizes the educing principle to draws forth a static or relative slow motion fluid (drawn-out fluid) and induce its movement using another fluid (drawer or motive fluid) as a medium. The reel can be operated by turning it to cause the string to wind or unwind and inserting the artifact into the motionless fluid container. The potential energy of the motive fluid transported through the string is transformed into kinetic energy when it passes through the artifact. The motive fluid, may be generally less dense than the motionless fluid, so it will play additional functions such as a solvent that support the dilution or density reduction of the fluid drawnout, and also as a lifter in the case of gas which will support raising the heavier fluid once both fluids mix outside the artifact. Lowing the density of the drawn fluid will reduce the backpressure at the source, which will make easier the transportation of the motionless fluid.

The invented artifact needs to be connected using a fluid conductor to a source with the drawer fluid. The fluid conductor is a string in the shape of a piping, tubing, or hose that allows the transportation of the drawer fluid until the artifact and allows changing the artifact position as well. Once the artifact is connected to the drawer fluid source, it should be set to the rate and pressure required and placed in at the location desired in contact with the fluid to drawn-out. If the fluid to drawn-out is already in slow motion, the artifact should be placed in a convenient location according the process requirements to accelerate the fluid transportation.

The drawer fluid to be used will depend on the application. For instance, for most of the oil producing processes, the fluid to use can be gas, but it also can be other low-density liquids. After mixing, the fluids can be separated, as necessary at the destination point.

The artifact may comprise other devices to support the process as required, increase efficiency, or add safety in the operations. The artifact can be installed together with a check valve, which can be in the same body of the artifact or in a separated section. In order to keep the artifact in the center of the container, the artifact also can be provided with a centralizer mechanism, which can be attached on the same body or apart of the artifact, depending on the application or geometrical configuration of the container or fluid transportation system. The artifact can also be provided of a sealing with an optional sealing mechanism, which comprises an external ring activated by the pressure exerted by the first fluid over the internal wall of the ring.

The operation of the artifact will be done at the source of the drawer fluid, where the rate and pressure will be set up at convenience. The rate and pressure can be eventually adjusted between periods of the time, in order to adapt the conditions to the process requirements. The position or elevation of the artifact can also be adjusted according the variation of the conditions in the process throughout the positioning mechanism to change the educing artifact location. This will provide flexibility and continuity for longer periods of operation adjusting the system according the process system or fluid reservoir behavior.

BRIEF DESCRIPTION OF THE DRAWINGS

To easier understand the nature and object of the current invention, reference is made to the accompanying drawings, in which.

DETAILED DESCRIPTION OF THE INVENTION

Figure 1:
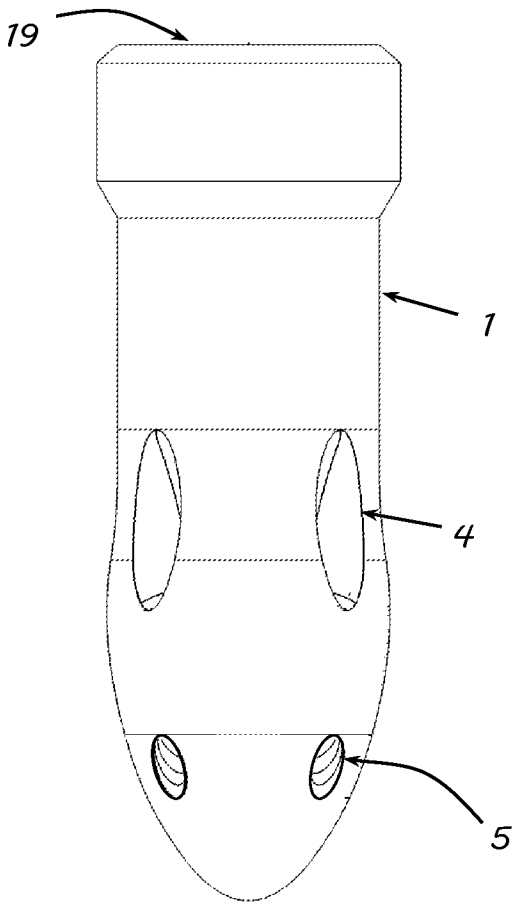
FIG. 1 illustrates an external view of the artifact in a configuration without external ring.

Referring now in a detailed manner to the figures above, in which the numerals identify the parts of the artifact and rest of the parts that comprise the whole system; the FIG. 1, represents an external side view of the educing artifact of the present invention, in a configuration without external ring. In this view are shown the body 1 of the artifact. It also shows the first fluid housing inlet 19 at the first end of the artifact, a plurality of second fluid housing inlets 5 where enter the fluid to be drawn, and a plurality of housing outlets 4 on the side.

Figure 2:
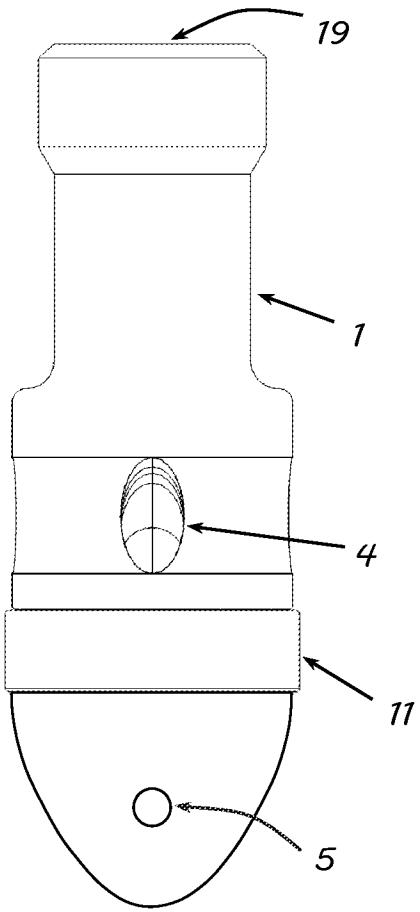
FIG. 2 illustrates an external view of the artifact in a configuration with external ring.

FIG. 2, represents an external side view of the educing artifact of the present invention, in a configuration with external ring. In this view are shown the body 1 of the artifact. It also shows the first fluid housing inlet 19 at the first end of the artifact, a plurality of second fluid housing inlets 5 where enter the fluid to be drawn, and a plurality of housing outlets 4 on the side. It also shows the external ring 11, which separates the suction section from the discharge section in the fluid container. Once out of the artifact, already in the discharge section, the motive fluid will help to raise the drawn fluid to the end of the transportation system or fluid container. The end of the transportation system or fluid container can be the surface in cases of subsurface facilities or subsea systems.

Figure 3:
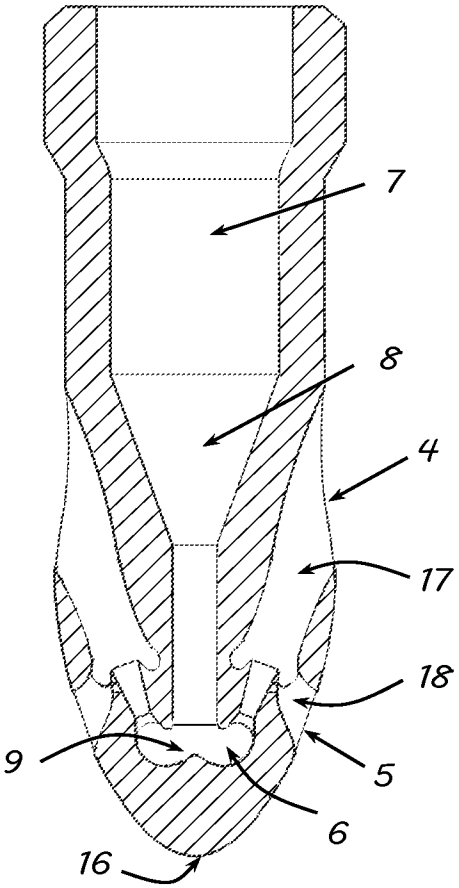
FIG. 3 shows a cross section of the artifact configured without external ring, where can be seen its internal chambers and diffusers.

The FIG. 3 illustrates a cross section of the artifact on the plane A-A in a configuration without external ring, showing the first fluid inlet chamber 7 where the motive fluid enters the artifact. It also shows the nozzle 8, where pressure is converted to kinetic energy. From this nozzle, the motive fluid then passes to the expansion chamber 6, which bottom is hyperbolic geometrically shaped, where the motive fluid expands uniformly when it impacts with the hyperbolic geometry expansion chamber prong 9, creating a low pressure environment in the second fluid inlet chambers 18, which draws the fluid in contact with the lower section or tip 16 of the artifact. Once outside the artifact, both the first and second fluids will travel downstream of the transportation system or fluid container, or vessel throughout the diffuser 17. The lighter the motive fluid is, the more the lifting action will be exerted on the drawn fluid.

Figure 4:
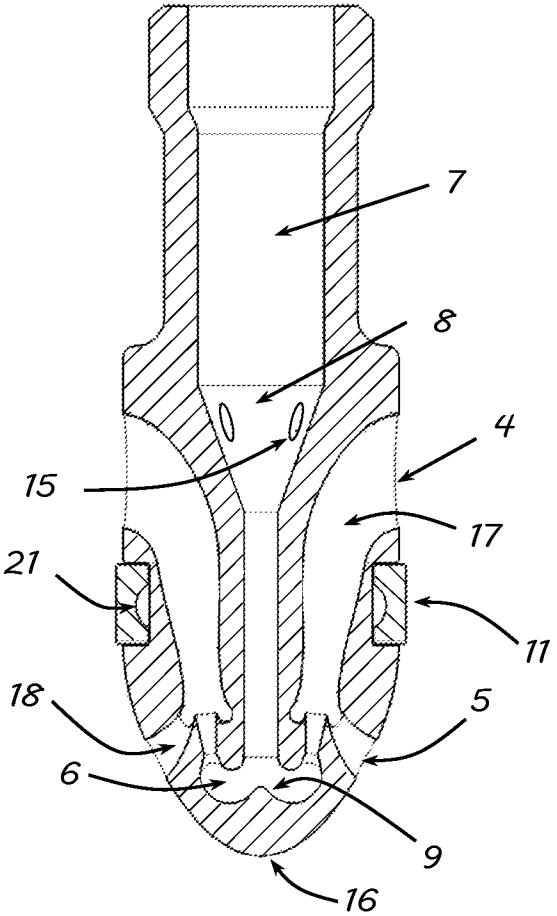
FIG. 4 shows a cross section of the artifact configured with external ring, where can be seen the external ring, the internal chambers and diffusers.

As in the previous figure, the FIG. 4 illustrates a cross section of the artifact on the plane A-A, but in a configuration with external ring 11, showing the first fluid inlet chamber 7 where the motive fluid enters the artifact. It also shows the nozzle 8, where pressure is converted to kinetic energy. From this nozzle, the motive fluid then passes to the expansion chamber 6, which bottom is hyperbolic geometrically shaped, where the motive fluid expands uniformly when it impacts with the expansion chamber prong 9, creating a low pressure environment in the second fluid housing inlets 5, which draws the fluid in contact with the lower section or tip 16 of the artifact. The figure also shows the diffuser 17, where the first and second fluids are accelerated and sent out of the artifact. The figure also shows the nozzle side outlets 15. On the inner wall of the external ring 11 cross-section can be seen the section of the external ring pressure groove 21, which is pressurized with motive fluid to expand the external ring 11.

Figure 5:
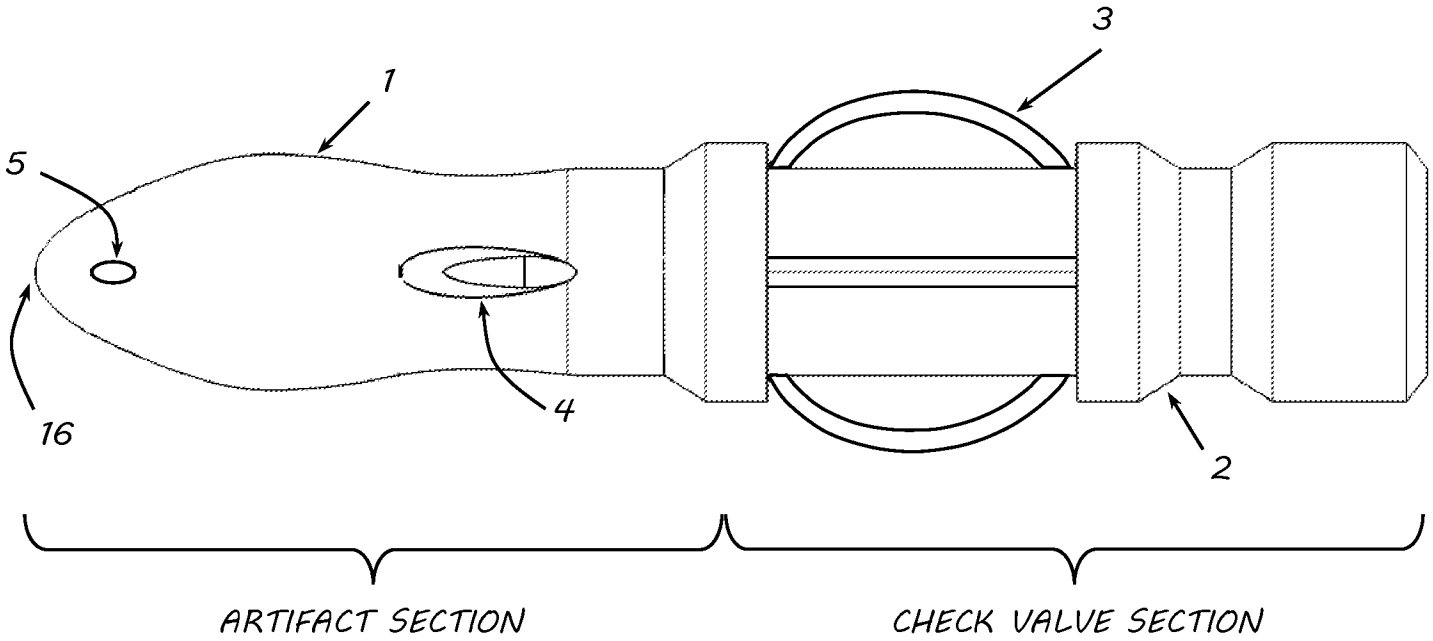
FIG. 5 illustrates the artifact together with a check valve in one body, including also the centralizers.

The FIG. 5 illustrates an outside view of the artifact together in one body with the check valve showing the body 1 of the artifact, the second fluid housing inlets 5 and a plurality of housing outlets 4 on the side. It also shows the location of the centralizers 3 and the check valve 2 when it is incorporated into the body. The centralizers 3 will hold the artifact in the exe (or center) of the motionless fluid container while the fluids are in contact with the body 1.

Figure 6:
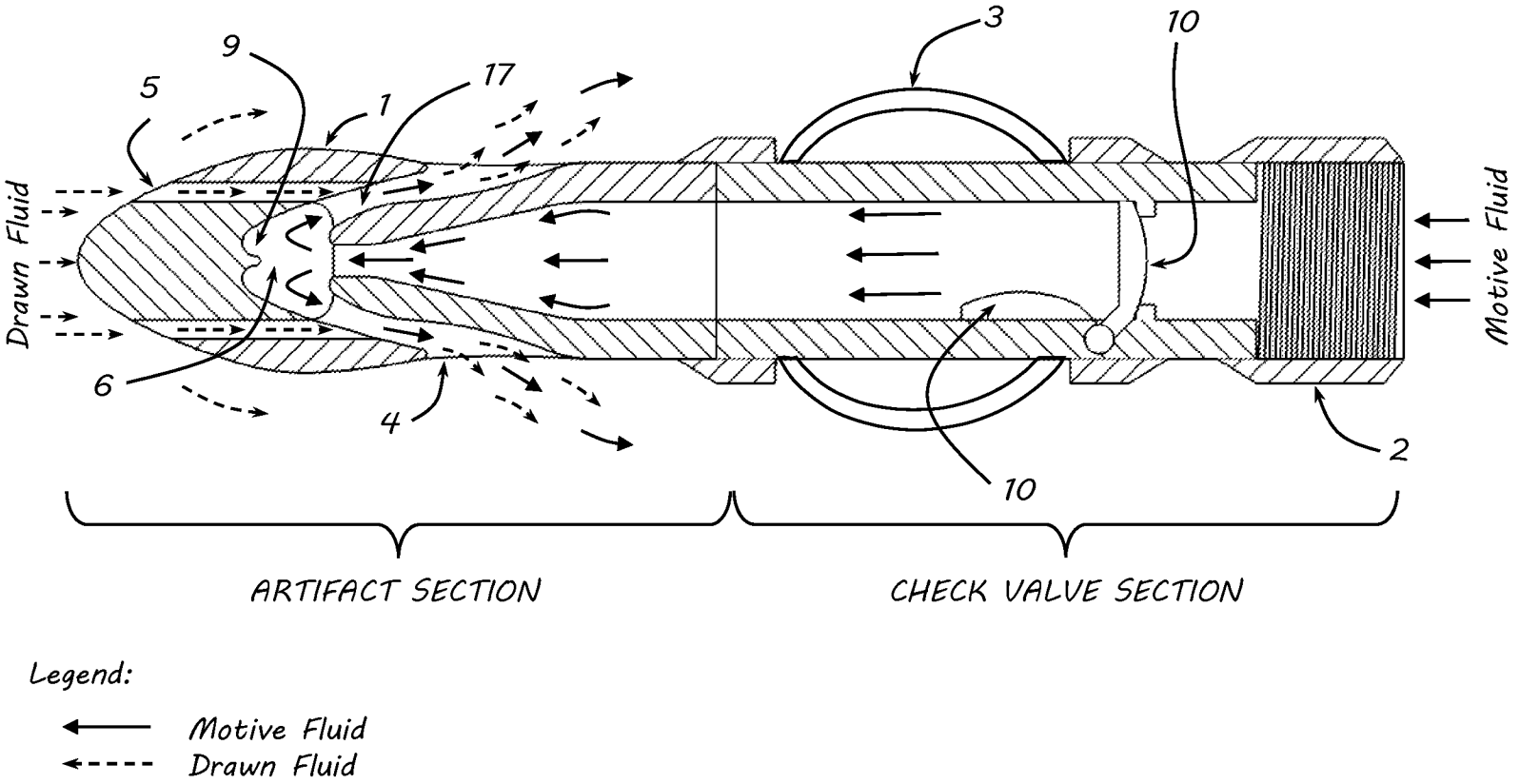
FIG. 6 illustrates a cross-section of the artifact in a configuration without external ring, together with a check valve, including indication using continue and dashed arrow marks to show the movement directions for the motive and drawn fluids respectively.

FIG. 6 illustrates a cross section of artifact without external ring, together in one body with the check valve 2. It shows the movement directions of the motive and drawn fluids inside the artifact. The continue arrows show the approximate direction of the motive fluid, while the dashed arrows show the approximate direction of the drawn fluid. It also shows the closing element 10 of the check valve 2 in two positions: open and close. It also shows the centralizers 3 attached the check valve 2.

Figure 7:
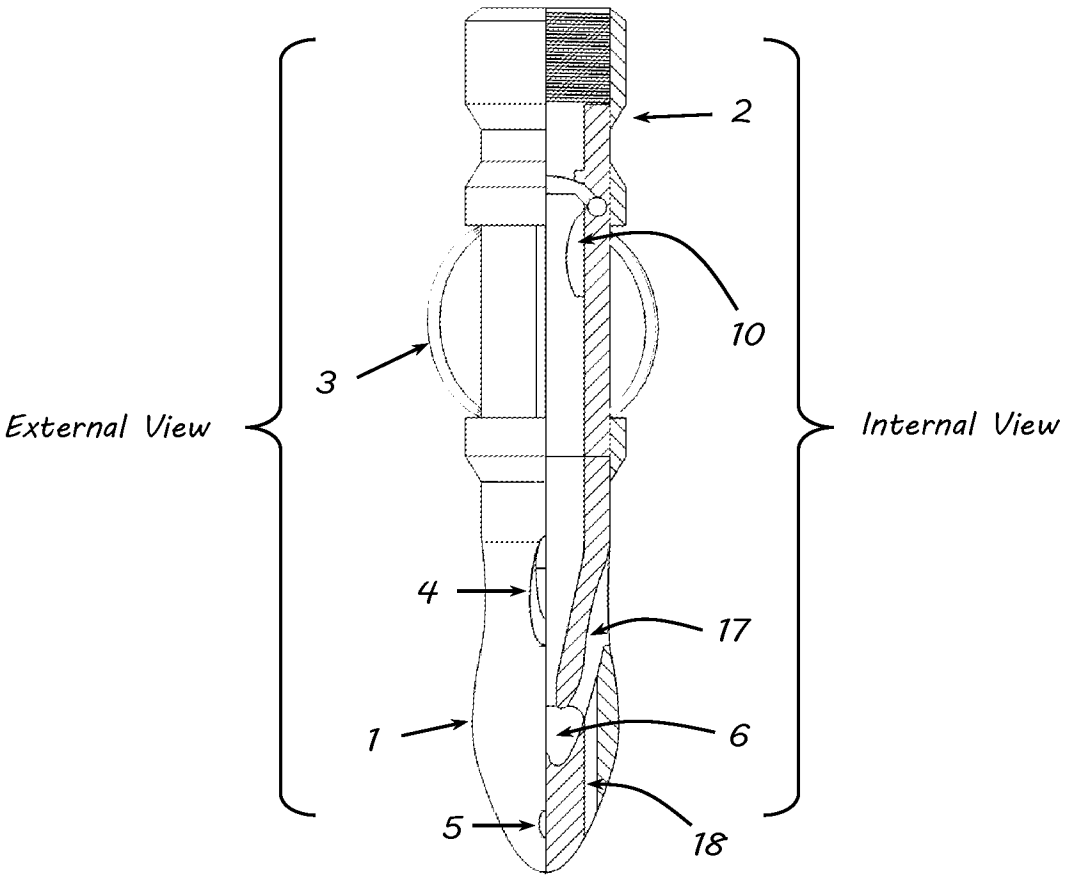
FIG. 7 is showing the artifact one half up to the centerline in section and the other half in full view. This figure allows look the internal and external parts of the artifact on the same picture, in a configuration without external ring.

FIG. 7 illustrates two half views (exterior and internal section) of the artifact together with the check valve 2. It shows the internal cavities of the second fluid housing inlets 5 and the plurality of housing outlets 4 on the side, as well as the closing element 10.

Figure 8:
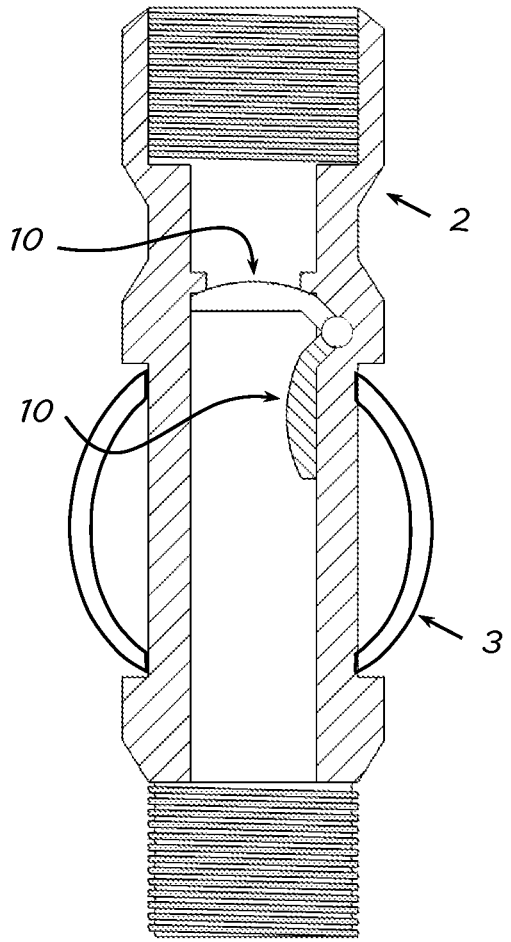
FIG. 8 shows a cross section of the check valve separated from the body of the artifact. In the figure are also shown part of the centralizers attached to the check valve and the centralizer elements. The figure also shows the close and open positions of the check valve.

FIG. 8 illustrates a cross section of the check valve 2 isolated in one embodiment. It shows the closing element 10 in two positions close and open, and the location of the centralizers 3 in case these are attached to the check valve 2 only.

Figure 9:
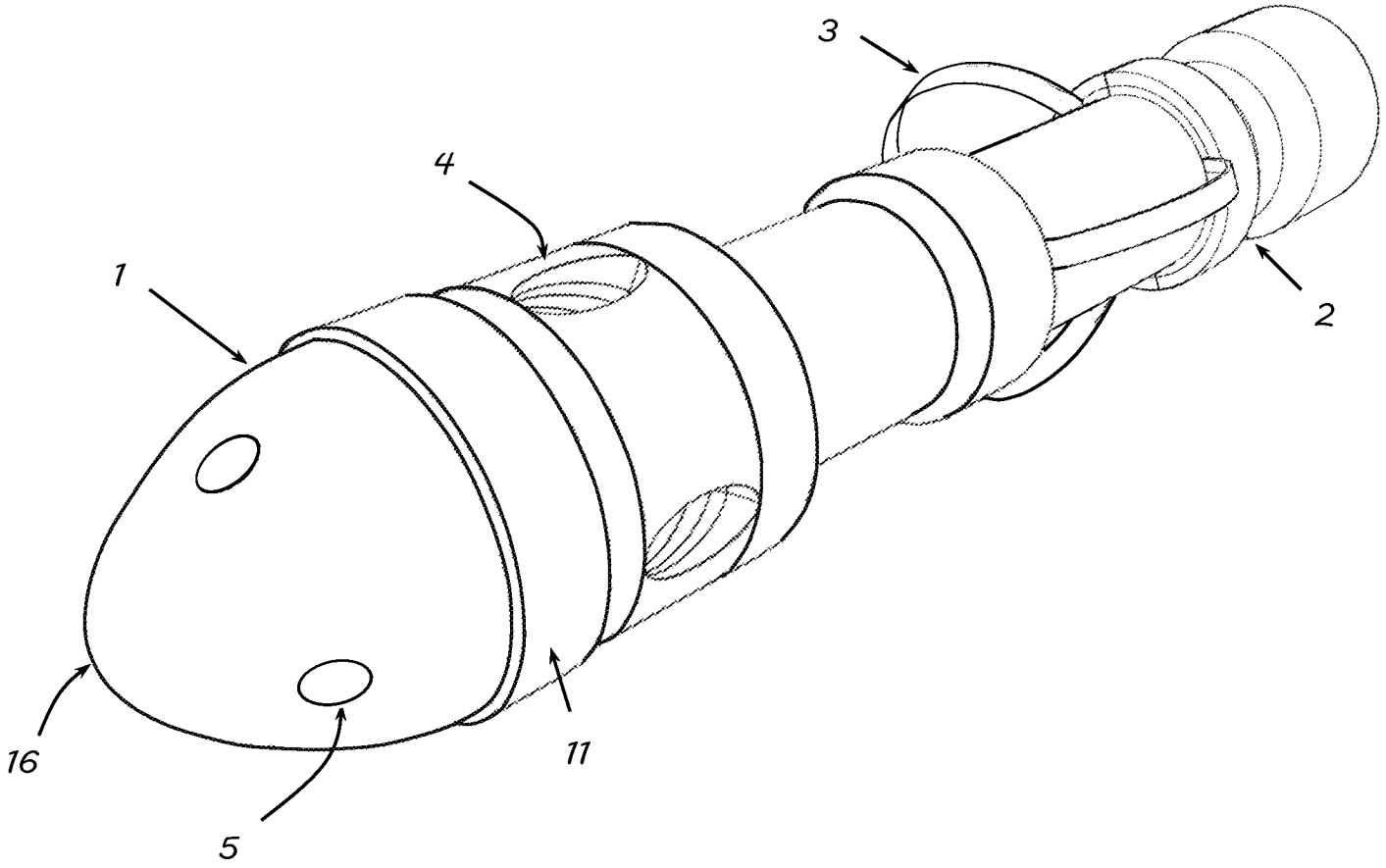
FIG. 9 illustrates a perspective picture of the artifact configured with external ring and the check valve attached.

FIG. 9 illustrates a perspective view of the artifact configured with external ring. On the view can be seen the body 1 of the artifact, the second fluid housing inlets 5, a plurality of housing outlets 4 on the side, the check valve 2, the centralizers 3 and the external ring 11 when it is incorporated into the body.

Figure 10:
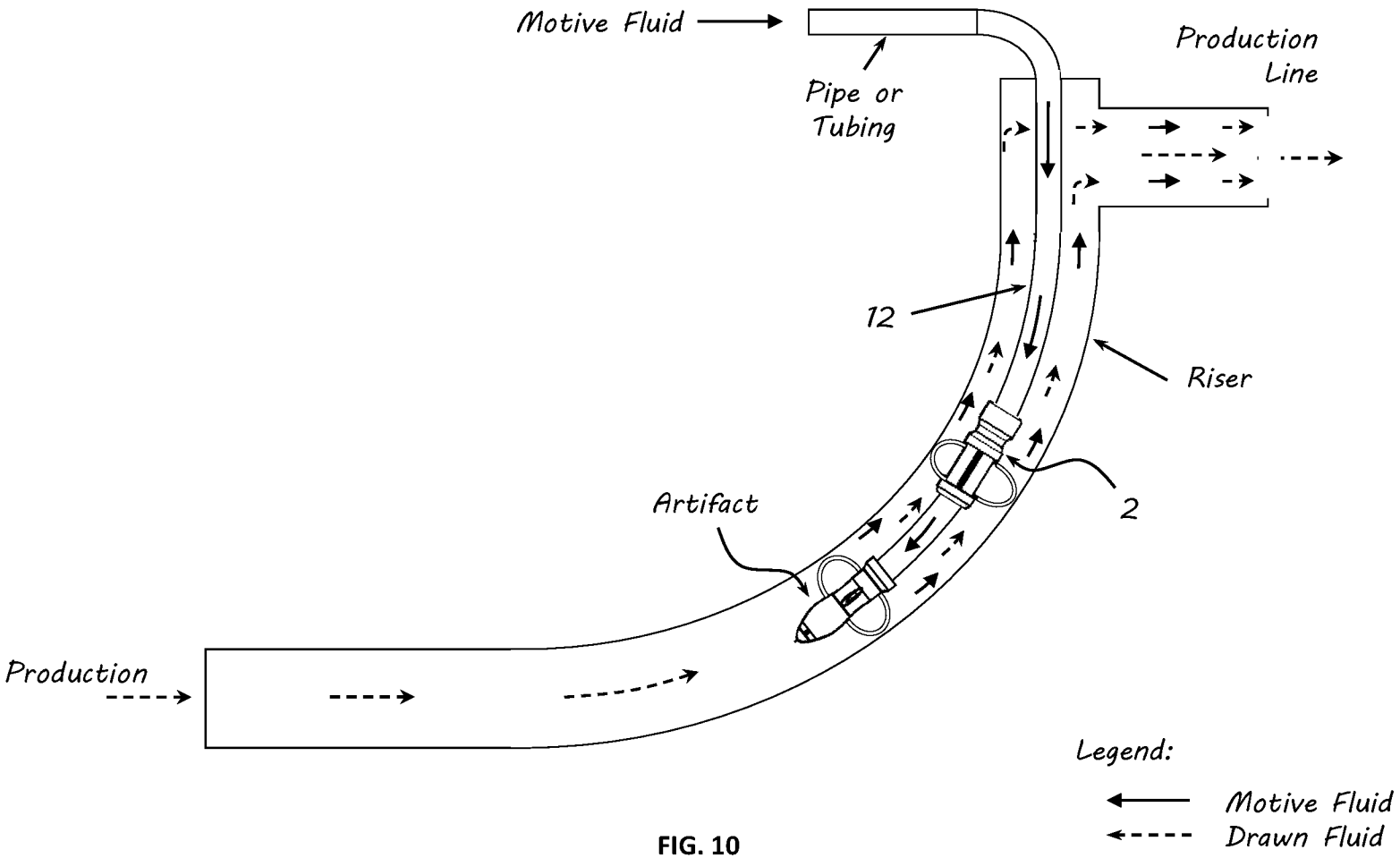
FIG. 10 is a scheme for the application of the artifact in a pipeline riser.

The FIG. 10 illustrates the application of the artifact in a riser, located on surface onshore or subsea offshore. As in the flowline application, the artifact can be connected to the source of motive fluid through a string, which is the motive fluid feeder 12. In this case the motive fluid will travel from top to bottom inside the motionless fluid container, once it gets in contact with the drawn fluid, it will help to raise the drawn fluid to the top of the riser. The figure shows the artifact configured without external ring and attached to the check valve 2.

Figure 11:
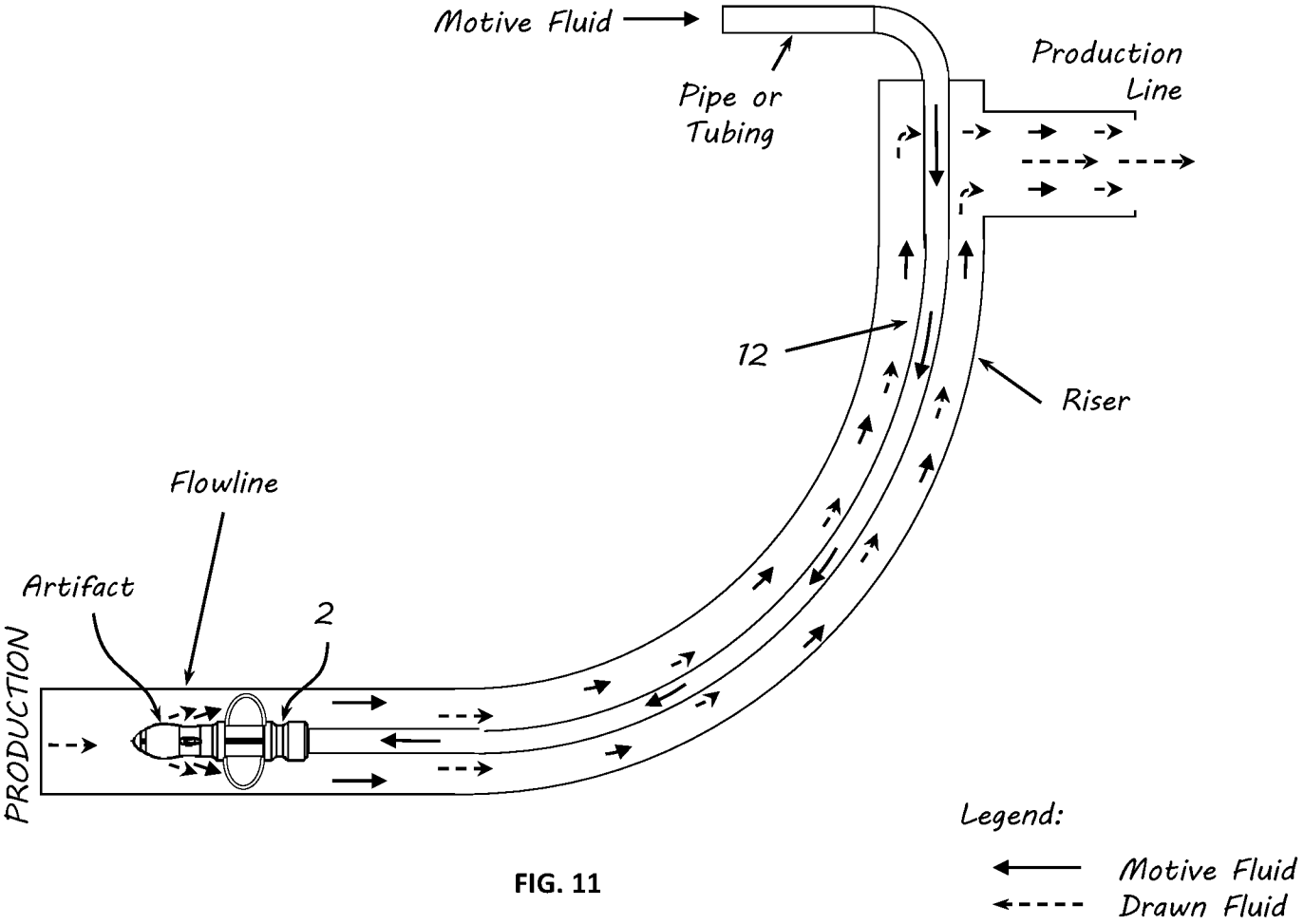
FIG. 11 is a scheme for the application of the artifact in a flowline.

The FIG. 11 illustrates the application of the artifact on flowlines, which may be located on surface onshore or subsea offshore. As in the riser application, the artifact can be connected to the source of motive fluid through a string, which is the motive fluid feeder 12. In this case the motive fluid will travel from top to bottom inside the tubing; once it gets in contact with the drawn fluid, it will help to raise the drawn fluid to the top of the flowline. The figure shows the artifact configured without external ring and attached to the check valve 2.

Figure 12:
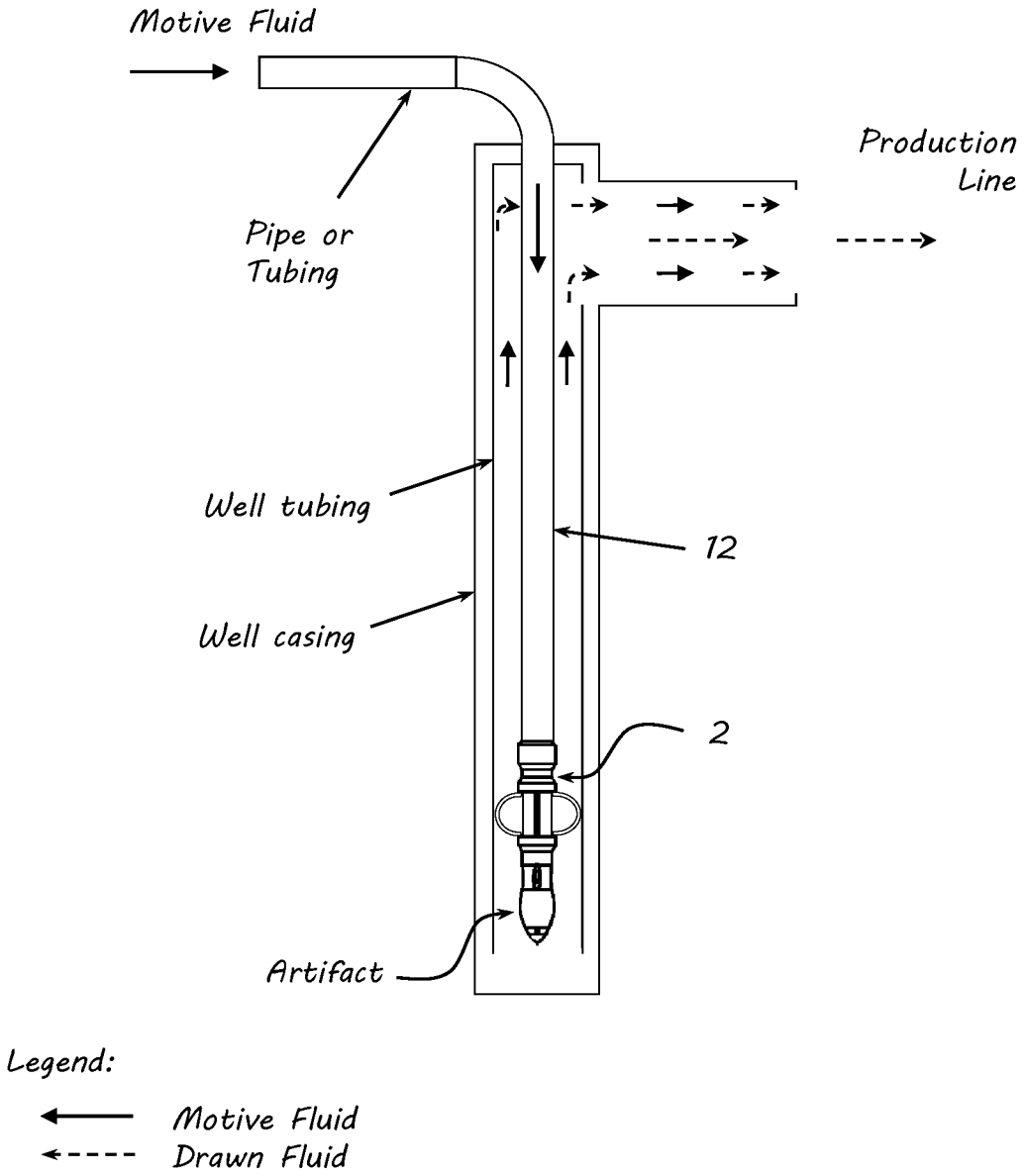
FIG. 12 illustrates the application of the artifact in a well.

FIG. 12 illustrates the application of the artifact lifting fluid from a vertical well. In this case the artifact can be connected through tubing to the source of the motive fluid. The figure shows the motive fluid feeder 12, the well tubing, the well casing, and the check valve 2, among other elements already identified on the figure.

Figure 13:
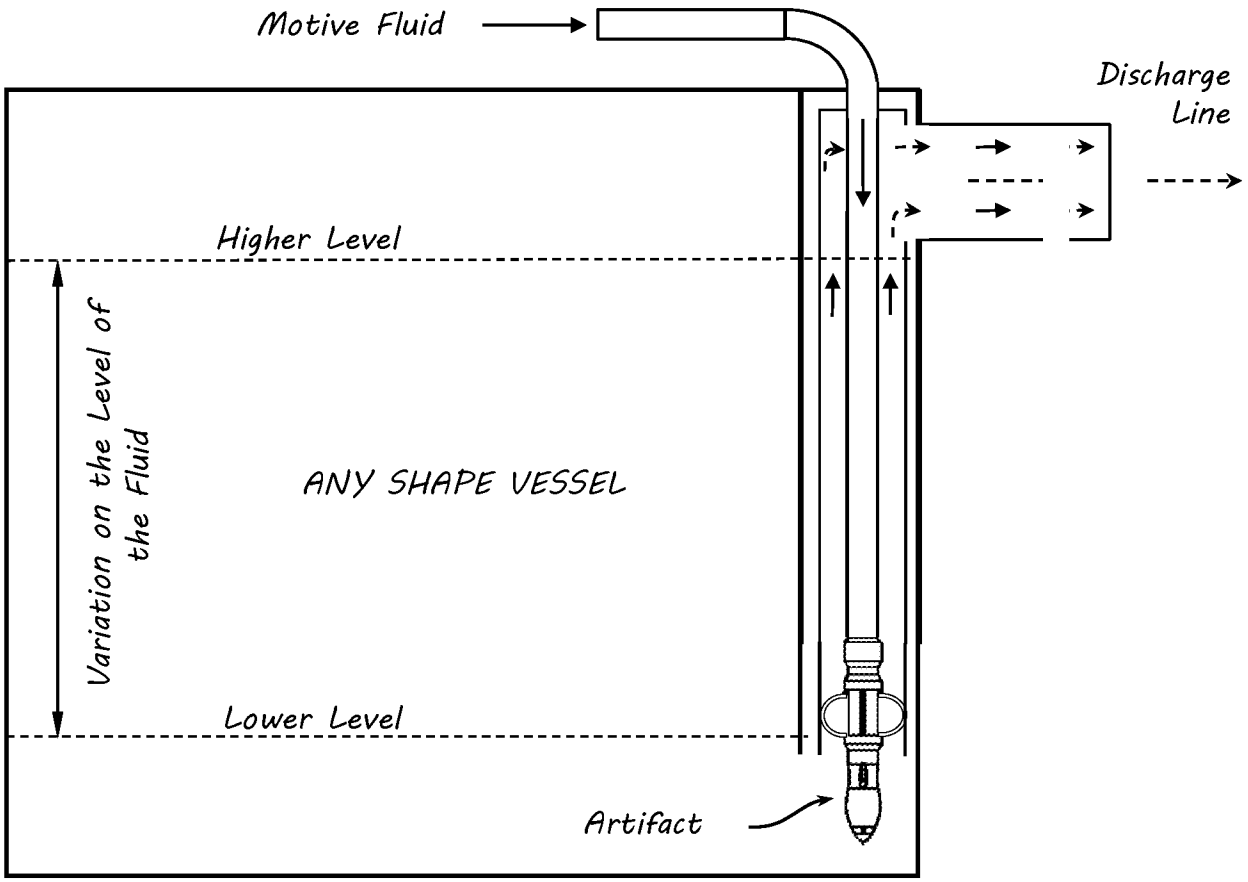
FIG. 13 illustrates the application of the artifact in an any shape fluid container.

The FIG. 13 illustrates the artifact installed in a vessel, which may have any physical shape.

Figure 14:
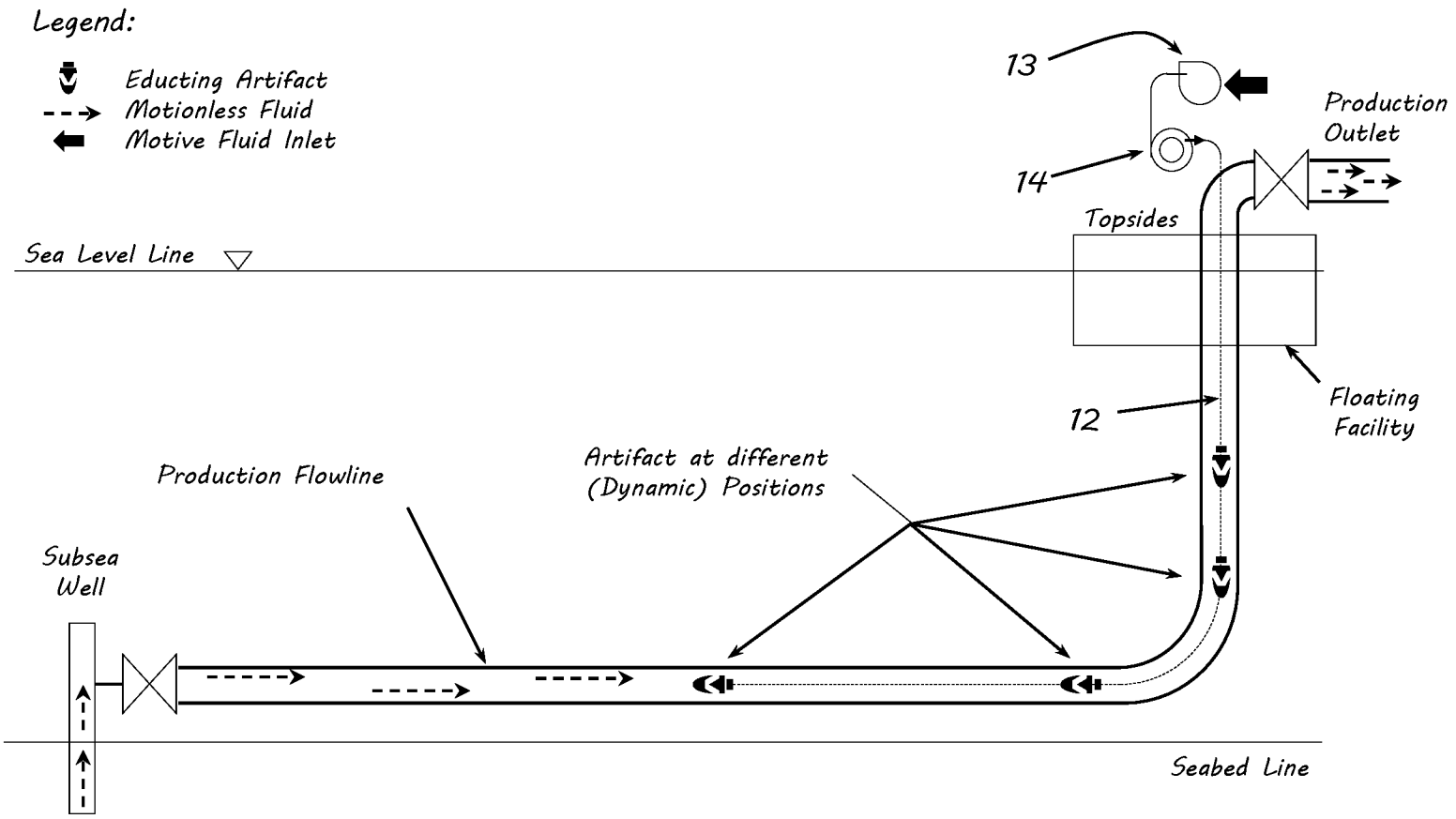
FIG. 14 is a schematic of the whole lifting system integrated by the artifact described here above, a feeder to carry the motive fluid, a mechanism to change the educing artifact position comprising a string reel that can be operated manually or automatically to wound or unwound the string, and a pumping or compression equipment to move the drawer fluid. It also shows the dynamic positioning capability of the artifact, showing how it can be placed in different positions along the fluid container that can be for instance a production or a fluid transportation system.

FIG. 14 is a representation of the whole dynamic positioning fluid lifting system for a subsea production application, comprising a first fluid feeder equipment 13, which can be a pump for liquid motive fluids or a compressor for gas motive fluids, a positioning mechanism 14 to change artifact position, which may be a combination of a string reel or hose, with a moving mechanism to be operated manually or automatically, the motive Fluid Feeder 12, which is the medium to transport the motive fluid. The figure is also representing the dynamic positioning capability of the educing artifact, described in detail above, showing it at various different positions along the production system. These different positions will vary in time according the process requirements. The representation of the system on this figure can be modified according the application to be given to the artifact, e.g. onshore, offshore, long or short distances.

Figure 15:
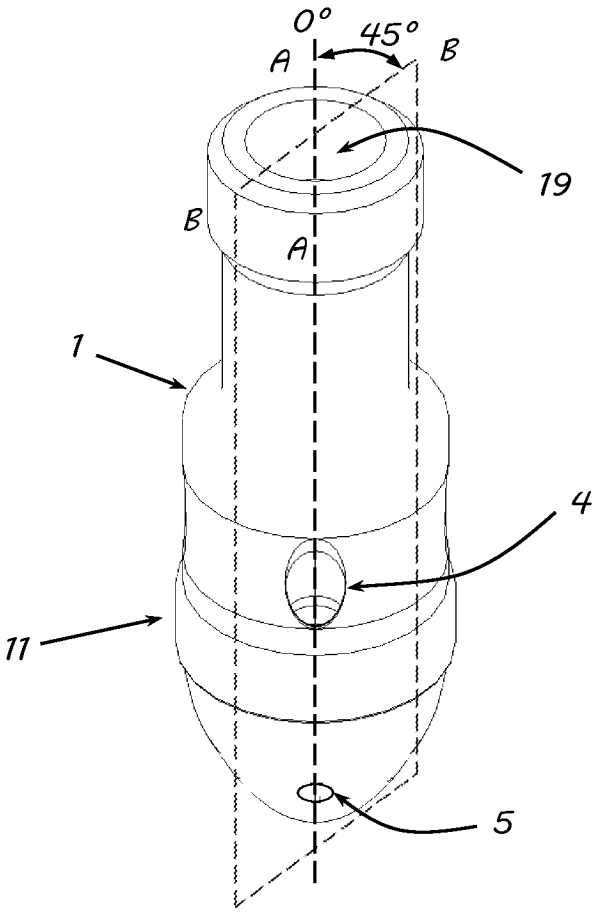
FIG. 15 shows an iso view of the artifact with external ring, also showing two vertical planes A-A and B-B concentric on the centerline of the artifact, separated by an acute angle, e.g., of 45 degrees. The planes are marking the position for the cross-section views on FIGS. 16 and 17.

FIG. 15 illustrates a perspective view of the artifact configured with external ring. On the view can be seen the body 1 of the artifact, the suction second fluid housing inlet 5, a plurality of housing outlets 4 on the side, the external ring 11, the first fluid housing inlet 19 at the first end of the artifact and are also shown two vertical planes A-A and B-B concentric on the centerline of the artifact, separated by an acute angle, e.g., of 45 degrees.

Figure 16:
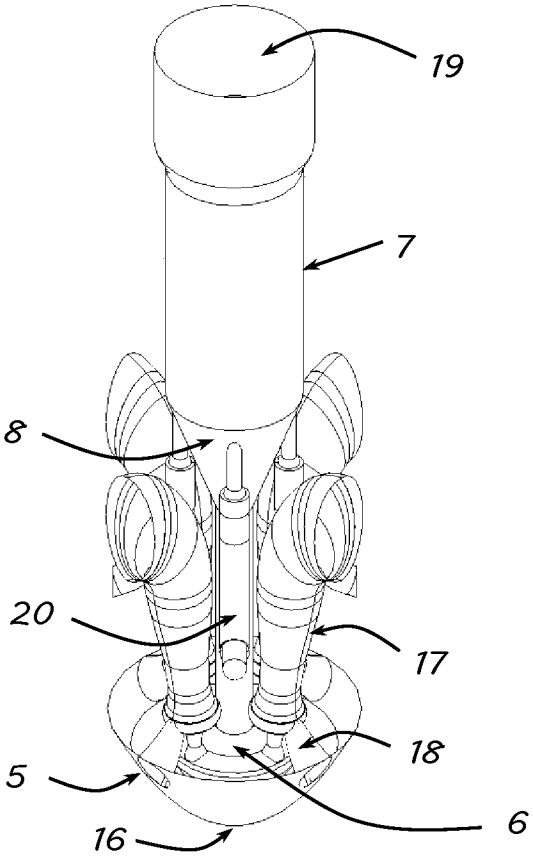
FIG. 16 is an iso view of the artifact configured with external ring. The figure shows views of the internal diffusers and chambers not shown in other figures, as well as the nozzle.

FIG. 16 is an iso view of the artifact configured with external ring. The figure shows the first fluid housing inlet 19 at the first end of the artifact, first fluid inlet chamber 7, the nozzle 8, the external ring pressure chambers 20, the diffusers 17, the second fluid housing inlets 5, the second fluid inlet chambers 18, the expansion chamber 6, and the tip 16 of the artifact.

Figure 17:
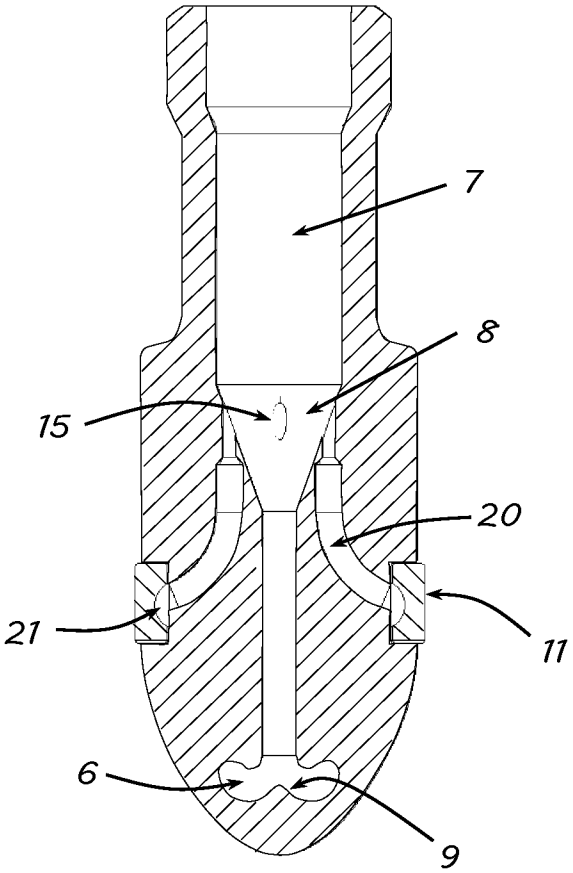
FIG. 17 illustrates the cross section of the artifact configured with external ring. In this section can be seen the external ring pressure chambers.

FIG. 17 illustrates the cross section of the artifact configured with external ring. In this section can be seen a cross-section of the external ring pressure chambers 20, the nozzle side outlets 15, the nozzle 8, the section of the external ring pressure groove 21, the external ring 11, the first fluid inlet chamber 7, the expansion chamber 6, and the expansion chamber prong 9.

Figure 18:
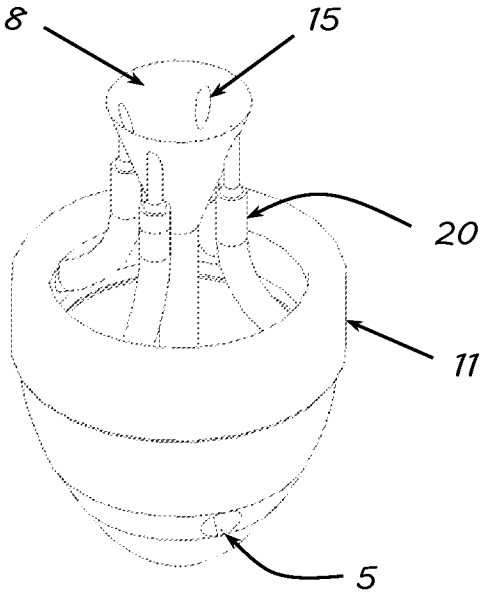
FIG. 18 illustrates an iso view of the lower section of the artifact showing different internal parts. In this figure can be seen the external ring compression chambers, the external ring, and the nozzle.

FIG. 18 illustrates an iso view of the lower section of the artifact showing the nozzle 8. In this figure can be seen the external ring compression chambers, the external ring, and the nozzle, the nozzle side outlets 15, the external ring pressure chambers 20, the external ring 11, and the second fluid housing inlets 5.

Figure 19:
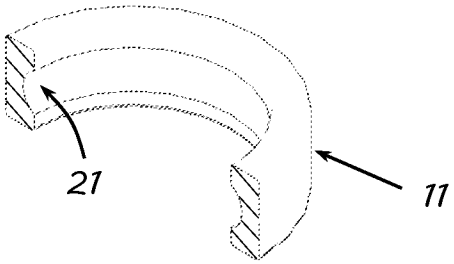
FIG. 19 illustrates an iso view and a cross-section of the external ring. In this figure can be seen the external ring pressure groove on the inner wall of the ring.

FIG. 19 illustrates an iso view and a cross-section of the external ring isolated, where can be seen the external ring pressure groove 21 on the inner wall of the ring, and the external ring 11.

In one exemplary embodiment, we have provided an artifact to draw fluids forth that can be built with or without an external ring, comprising: a. An aerodynamic body housing resembling a bullet having an inlet main chamber followed by a nozzle chamber which at the same time is connected to an expansion chamber, and this last one is at the same time connected to several upper and lower sub chambers or diffusers. The number of chambers or diffusers connected to the expansion chamber must be determined according the process requirements and the nature of the fluids to be used in the process. The sub chambers or diffusers are shaped such as the upper sub chambers turn close to plain angle forming an arrangement of smaller chambers in acute angle. Each sub chamber is aerodynamic shaped going progressively from a small inlet to a larger outlet in a divergent shape, along the cavity until the edge or exterior of the artifact's body. In the same way the lower sub chambers located at a lower latitude of the body, connects in a tangent internally with the upper sub chambers. These chambers are also aerodynamic shaped, going progressively from a large entrance or inlet to a smaller outlet in a convergent shape along the cavity, b. The expansion chamber possessing a prong that allows the fluid to expand uniformly at high velocity and in a desired angle, c. The centralizer elements that can be installed or not installed according the length and requirements of the process, d. The artifact further comprising a check valve disposed in its housing. The check valve permits the fluid communication from the inlet to the outlet and restricts fluid communication from the outlet to the inlet of the string or coiled tubing. This check valve may be or not installed together with the artifact.

In one exemplary embodiment, we have provided a sealing mechanism or ring that can be incorporated when desired around the above-described artifact, operated by pressure across different chambers or conducts throughout inside the body of the artifact. The mechanism seals the space between the vessel and the body of the artifact. The seal comprises a sealing ring which rest in a groove in the body of the artifact. The ring expands through the mechanism activated by pressure from the inside of the artifact. The seal will block communication between the lower and the upper sides of the vessel from the location of the artifact, allowing the fluid to pass only throughout the chambers of the artifact.

In one exemplary embodiment, we have provided the attached elements required to introduce the above-described artifact into a pipe, vessel or riser without interrupt the production or the process going on. This can be a "hot tapping" or "cold tapping" procedure that further comprise a string tubing with threaded connection at the ends that allows the connection to the artifact and to an internal threaded flange with threaded pipe extension that allows to block the system during the operation. A threaded plug to be installed for safety blocking. An external flange with internal threads which will be connected to the pipe, vessel or riser.

In one exemplary embodiment, we have provided for the above-described artifact's use in a process conducted about the artifact, in which fluids acting in its internal aerodynamically shaped chambers can produce a vacuum effect to move forth or lift out a motionless fluid.

In one exemplary embodiment, we have provided a mechanism that allows to change manually or automatically the position of the injection point of a motive fluid, being gas or liquid, along the vessel, production flowline, well or riser.

In one exemplary embodiment, we have provided a whole dynamic positioning fluid lift system integrated by the above-described artifact, a tubing to carry the motive fluid connected to the artifact with capability to change position inside the vessel, production flowline or riser using a moving mechanism, which can be operated manually or automatically, and the process described in the claim 4 above.

In one exemplary embodiment, we have provided an artifact of which its use can be described as "Dynamic Position Gas Lift" and "Dynamic Position Fluid Lift" depending of the motive fluid to be used in the application.

In one exemplary embodiment, we have provided an artifact comprising: an elongated housing having: a first end, a side and a second end, the housing having an inlet chamber at the first end for receiving a first fluid, wherein the first fluid is directed toward the housing second end, the second end having a tip and a plurality of housing inlets, the plurality of housing inlets to introduce a second fluid, the housing further having a plurality of housing outlets on the side of the housing, located between the first and the second ends; a nozzle in fluid communication with the inlet chamber, wherein the nozzle is used to compress and accelerate the first fluid, the nozzle having a plurality of nozzle side outlets; an expansion chamber, the nozzle directing the first fluid to the expansion chamber, the expansion chamber having a prong, the prong being contacted by the first fluid exiting the nozzle, wherein the prong splits up the first fluid into a plurality of first fluid portions, disseminating the first fluid in the expansion chamber, wherein each of the plurality of first fluid portions changes direction toward the housing outlets; a plurality of diffusers, each of the plurality of diffusers partially reversing the first fluid direction, each of the plurality of diffusers having an inlet portion and a diffusing portion, each of the plurality of inlet portions in connection with the expansion chamber, wherein each of the plurality of inlet portions receives one of the plurality of the first fluid portions from the expansion chamber, each of the plurality of diffusing portions defining a progressively larger cross-sectional area flow path from the inlet portion to one of the plurality of the housing outlets; a plurality of housing second fluid inlet chambers each extending from the plurality of housing inlets to one of the plurality of diffusers, each housing second fluid inlet chamber directing the second fluid toward the housing first end, wherein the second fluid in each of the plurality of housing second fluid inlet chambers joins one of the plurality of diffusers, such joinder at an intersection of such housing second fluid inlet chamber with such one diffuser, the intersection forming an acute angle, each of the plurality of housing second fluid inlet chambers having a first end at the plurality of housing inlets, initially receiving the second fluid, and a second end at such intersection, each such housing second fluid inlet chamber defining a progressively smaller cross-sectional area, the cross-sectional area of each such housing second fluid inlet chamber decreasing from such chamber's first end to such chamber's second end; a sealing mechanism, comprising a ring circumferentially positioned around the housing, wherein the ring seals between the housing and a container of the second fluid, the ring having a semicircle groove on the inner wall; and a plurality of pressure chambers each extending from the plurality of nozzle side outlets to the semicircle groove on the inner wall of the ring, each pressure chamber directing a portion of the first fluid toward the semicircle groove on the inner wall of the ring, wherein the first fluid in each of the plurality of pressure chambers exert pressure upon the semicircle groove on the inner wall of the ring, each of the plurality of pressure chambers having a first end plurality of nozzle side outlets, initially receiving the first fluid, and the second end at semicircle groove on the inner wall of the ring, each of the plurality of pressure chambers defining a progressive larger cross-sectional area in two steps size diameters, the cross-sectional area of each such plurality of pressure chambers decreasing from such chamber's first end to such chamber's second end; wherein the ring is operated by pressure across the optional plurality of pressure chambers, the ring thereby expanding to provide the seal.

In one exemplary embodiment, the above-described artifact is configured such that, when put together with a blowout preventer (BOP) system used to seal, control and monitor well production while the artifact is introduced into a fluid container without interrupting the production.

In one exemplary embodiment, we have provided that the fluids acting in the above-described artifact diffusers and chambers produce a vacuum effect outside the second end of the housing to move forth or lift-out a motionless fluid.

In one exemplary embodiment, we have provided that the above-described artifact is usable with a dynamic artificial lifting mechanism for manually or automatically changing the position of the injection point of the motive fluid, the motive fluid being gas or liquid, along one or more of a fluid container, vessel, production flowline, well or riser.

In one exemplary embodiment, we have provided that the dynamic artificial lifting mechanism comprises a string wound in a reel, the string used to transport the first fluid into the artifact, the string connected to the first end of the artifact, the reel being operated manually with an option to be automized to unwind or rewind the string on such reel, wherein winding or unwinding the string on the reel is the mechanism to change the position of the artifact when the artifact is placed inside a second fluid container, the end of the string opposite to the connection with the first end of the artifact being connected to a pumping or compression well known system.

In one exemplary embodiment, we have provided a check valve positioned proximate the housing first end for preventing the first fluid from exiting the housing through the inlet chamber.

In one exemplary embodiment, we have provided that a plurality of centralizer elements coupled to the check valve.

The invention claimed is:

1. An artifact, comprising:

an elongated housing having:

a first end, a side and a second end, the housing having an inlet chamber at the first end for receiving a first fluid, wherein the first fluid is directed toward the housing second end, the second end having a tip and a plurality of housing inlets, the plurality of housing inlets to introduce a second fluid, the housing further having a plurality of housing outlets on the side of the housing, located between the first and the second ends;

a nozzle in fluid communication with the inlet chamber, wherein the nozzle is used to compress and accelerate the first fluid, the nozzle having a plurality of nozzle side outlets;

an expansion chamber, the nozzle directing the first fluid to the expansion chamber, the expansion chamber having a prong, the prong being contacted by the first fluid exiting the nozzle, wherein the prong splits up the first fluid into a plurality of first fluid portions, disseminating the first fluid in the expansion chamber, wherein each of the plurality of first fluid portions changes direction toward the housing outlets;

a plurality of diffusers, each of the plurality of diffusers partially reversing the first fluid direction, each of the plurality of diffusers having an inlet portion and a diffusing portion, each of the plurality of inlet portions in connection with the expansion chamber, wherein each of the plurality of inlet portions receives one of the plurality of the first fluid portions from the expansion chamber, each of the plurality of diffusing portions defining a progressively larger cross-sectional area flow path from the inlet portion to one of the plurality of the housing outlets;

a plurality of housing second fluid inlet chambers each extending from the plurality of housing inlets to one of the plurality of diffusers, each housing second fluid inlet chamber directing the second fluid toward the housing first end, wherein the second fluid in each of the plurality of housing second fluid inlet chambers joins one of the plurality of diffusers, such joinder at an intersection of such housing second fluid inlet chamber with such one diffuser, the intersection forming an acute angle, each of the plurality of housing second fluid inlet chambers having a first end at the plurality of housing inlets, initially receiving the second fluid, and a second end at such intersection, each such housing second fluid inlet chamber defining a progressively smaller cross-sectional area, the cross-sectional area of each such housing second fluid inlet chamber decreasing from such chamber's first end to such chamber's second end;

a sealing mechanism, comprising a ring circumferentially positioned around the housing, wherein the ring seals between the housing and a container of the second fluid, the ring having a semicircle groove on the inner wall; and a plurality of pressure chambers each extending from the plurality of nozzle side outlets to the semicircle groove on the inner wall of the ring, each pressure chamber directing a portion of the first fluid toward the semicircle groove on the inner wall of the ring, wherein the first fluid in each of the plurality of pressure chambers exert pressure upon the semicircle groove on the inner wall of the ring, each of the plurality of pressure chambers having a first end plurality of nozzle side outlets, initially receiving the first fluid, and the second end at semicircle groove on the inner wall of the ring, each of the plurality of pressure chambers defining a progressive larger cross-sectional area in two steps size diameters, the cross-sectional area of each such plurality of pressure chambers decreasing from such chamber's first end to such chamber's second end;

wherein the ring is operated by pressure across the plurality of pressure chambers, the ring thereby expanding to provide the seal.

2. The artifact of claim 1, wherein the artifact is configured such that, when put together with a blowout preventer (BOP) system used to seal, control and monitor well production while the artifact is introduced into a fluid container without interrupting the production.

3. The artifact of claim 1, wherein the fluids acting in the diffusers and chambers produce a vacuum effect outside the second end of the housing to move forth or lift-out a motionless fluid.

4. The artifact of claim 1, wherein the artifact is usable with dynamic artificial lifting mechanism for manually or automatically changing the position of the injection point of a motive fluid, the motive fluid being gas or liquid, along one or more of a fluid container, vessel, production flowline, well or riser.

5. The artifact of claim 4, wherein the dynamic artificial lifting mechanism comprises a string wound in a reel, the string used to transport the first fluid into the artifact, the string connected to the first end of the artifact, the reel being operated manually with an option to be automized to unwind or rewind the string on such reel, wherein winding or unwinding the string on the reel is the mechanism to change the position of the artifact when the artifact is placed inside a second fluid container, the end of the string opposite to the connection with the first end of the artifact being connected to a pumping or compression well known system.

6. The artifact of claim 1, further comprising a check valve positioned proximate the housing first end for preventing the first fluid from exiting the housing through the inlet chamber.

7. The artifact of claim 6, further comprising a plurality of centralizer elements coupled to the check valve.

* * * * *